United States Patent [19]

Simpson

[11] 4,160,549

[45] Jul. 10, 1979

[54] TENNIS SERVE TRAINING AND PRACTICE DEVICE

[76] Inventor: John P. Simpson, 36 Winthrop Rd., Brentwood, N.Y. 11717

[21] Appl. No.: 871,082

[22] Filed: Jan. 19, 1978

Related U.S. Application Data

[63] Continuation-in-part of Ser. No. 726,676, Sep. 27, 1976, abandoned.

[51] Int. Cl.[2] ..... A63B 69/38

[52] U.S. Cl. ..... 273/29 A; 273/105 R

[58] Field of Search ..... 273/55 B, 26 A, 29 A, 273/105 A, 181 A, 181 F, 127 R, 102 S, 102.4, 1 B, 85 R, 105 R; D34/5 VV

[56] References Cited

U.S. PATENT DOCUMENTS

| | | | |
|---|---|---|---|
| 237,808 | 11/1975 | Ekstrand | D34/5 VV |
| 241,151 | 8/1976 | Covino | D34/5 VV |
| 3,039,770 | 6/1962 | Ferretti | 273/26 A |
| 3,583,703 | 6/1971 | Brown | 273/26 A |
| 3,633,909 | 1/1972 | Doynow | 273/26 A |
| 3,820,787 | 6/1974 | Heinbinger | 273/55 B |
| 4,082,271 | 4/1978 | Martin | 273/26 A |

FOREIGN PATENT DOCUMENTS

| | | | |
|---|---|---|---|
| 999733 | 3/1963 | United Kingdom | 273/85 R |

*Primary Examiner*—Richard C. Pinkham
*Assistant Examiner*—T. Brown
*Attorney, Agent, or Firm*—Kane, Dalsimer, Kane, Sullivan and Kurucz

[57] ABSTRACT

An adjustable target for practicing tennis serves on a regulation size tennis court comprises a substantially rectangular frame defining an enclosure through which the tennis balls may pass. The frame includes two mutually slidable U-shaped side members. The upper leg of each side member is slidable in an upper telescoping member and the lower leg of each side member is slidable in a lower telescoping member having a downwardly extending adjustable leg and telescoped within a main upright support telescoped over an upwardly extending arm of a base. A brace extends rearwardly from the top of the frame and is adjustable therewith in a lateral direction for advantageously cooperating in releasably attaching a removable net for receiving, catching and holding the served tennis balls penetrating the opening defined by the frame.

8 Claims, 6 Drawing Figures

TENNIS SERVE TRAINING AND PRACTICE DEVICE

REFERENCE TO RELATED APPLICATION

This application is a continuation-in-part of application Ser. No. 726,676 filed Sept. 27, 1976 (abandoned).

BACKGROUND OF THE INVENTION

In the sport of tennis, short of actually hitting serves towards the service court and visually observing whether the ball landed inside or outside, an effective training device for tennis serves has not been devised and offered to the sport. Typical of such prior art proposals is U.S. Pat. No. 3,215,432. However, the device disclosed in this patent is somewhat complicated in design and does not possess that degree of portability enabling the device to be conveniently related to and used on a regulation tennis court. Another prior art proposal appears in U.S. Pat. No. 3,966,205, which assumes an even greater degree of complexity and sophistication and has as its primary objective the practicing of serves at a location other than a tennis court. This patentee suggests that his device can also be used on tennis courts, however, the target area of this device is unduly large and does not bear a reasonable relationship to the serving court area. Towards this end, the width of this device is almost equal to half the width of a regulation court with one end of the device adapted to be aligned with the center line on the tennis court. It has been concluded that the patentee's target area is unnecessarily large and that the inner end of the target device need not be aligned with the center line on the court. Unfortunately, good serves as well as bad serves would not be effectively indicated. The primary cause of this occurrence is the different locations from which the player would serve. Thus, a ball may be served and travel outside the inner end of the target device and yet drop into the service court. Similarly, a ball may be served which is within the target device yet in actuality the ball will fall out of the service court. The patentee has mistakenly assumed that a player serves from the precise center of the service line, when in fact, he is considerably right of the center line when serving to the right service court and considerably left of the center line when serving to the left service court.

SUMMARY OF THE INVENTION

This invention relates to devices for use in practicing tennis serves.

It is an object of this invention to overcome the limitations and disadvantages in the tennis service training devices of the prior art and those currently available on the market.

One of the objects of the invention is to provide a tennis serve practice device embodying improved advanced principles of design and construction and geometrically designed to assure that a tennis ball properly hit through the target area will land in the opponent's service court.

A further objective of the invention is to provide a tennis serve practice device that will optimize the serve from any position of the base line.

Another objective of the tennis service device is its unique capability of providing varying levels of penetration into the service box.

An important object of the invention is to provide a tennis service practice device which is comprised of a minimum number of durable parts which can be economically manufactured and readily assembled.

Another object of the invention is to provide a tennis serve practice device which is easily foldable for storage and transportation in an automobile.

A further object of the invention is to provide a tennis serve practice device which may be used by one or more persons on a regulation tennis court, such as in an individual practice session, for demonstration and practice in a tennis improvement class by both instructor and students, or by several tennis players collectively practicing their serves.

An additional object of the invention is to provide a tennis serve practice device with a net for catching the tennis balls so that the player practicing may save time and energy by not having to run after and retrieve stray balls.

A net brace cooperates in suspending the net providing increased collection space for collecting tennis balls and at the same time reduces collection time spent in gathering tennis balls. Additional collection space by increased bottom surface area, for collecting tennis balls will provide the instructor with additional time to devote to instructions. The provisions of the brace adds a three dimensional effect (depth) to the training device, and the support net prevents tennis balls for dropping to the ground. If the net hung straight, a served tennis ball would have a tendency to drop to the surface ground rather than being retained by the net.

A further object of the invention is to provide a tennis serve practice device with an optional, removable net so that individuals particularly practice their tennis serves on the court without the net and see the flight of the balls into the service box. This tunneling effect adds another dimension to the device and assists the instructor in spotting the serve. Moreover, the device may be used to practice against a handball court or other court wall, without the use of the net.

An additional object of the invention is to provide a tennis serve practice device with an adjustable rectangular enclosure target area which may be opened for less experienced players and closed to accommodate more experienced players, according to their level of skill.

Further objects and advantages of this invention will appear more clearly from the following description of a non-limiting illustrative embodiment and the accompanying drawings in which like numerals designate like parts throughout the several views.

DESCRIPTION OF THE DRAWINGS

Briefly summarized, a preferred embodiment of the invention is described in conjunction with an illustrative disclosure thereof in the accompanying drawings, in which.

DETAILED DESCRIPTION OF THE PREFERRED EMBODIMENT

Figure 1:
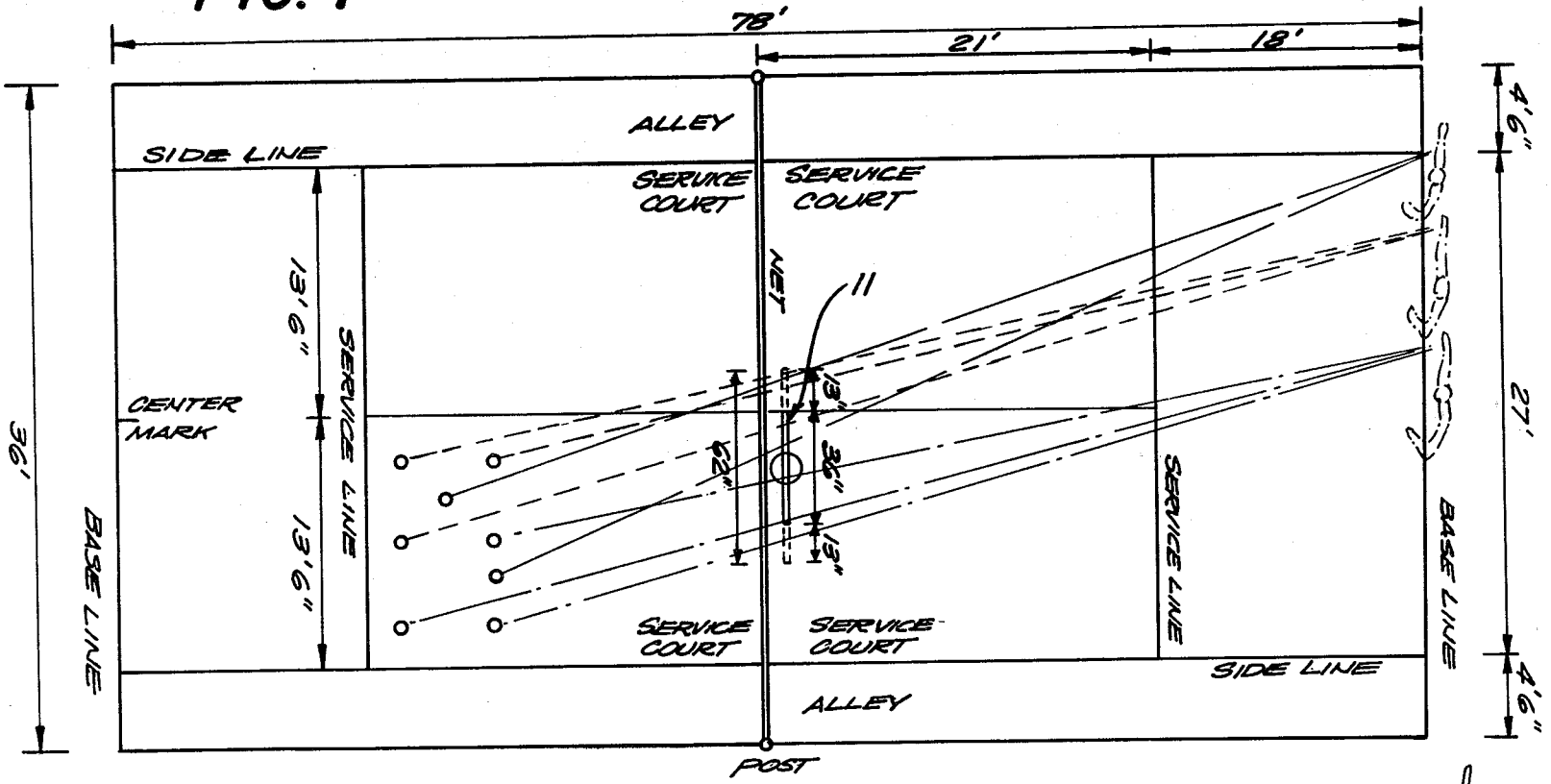
FIG. 1 is a plan view of a regulation tennis court diagrammatically illustrating the attributes of the present invention.
Figure 2:
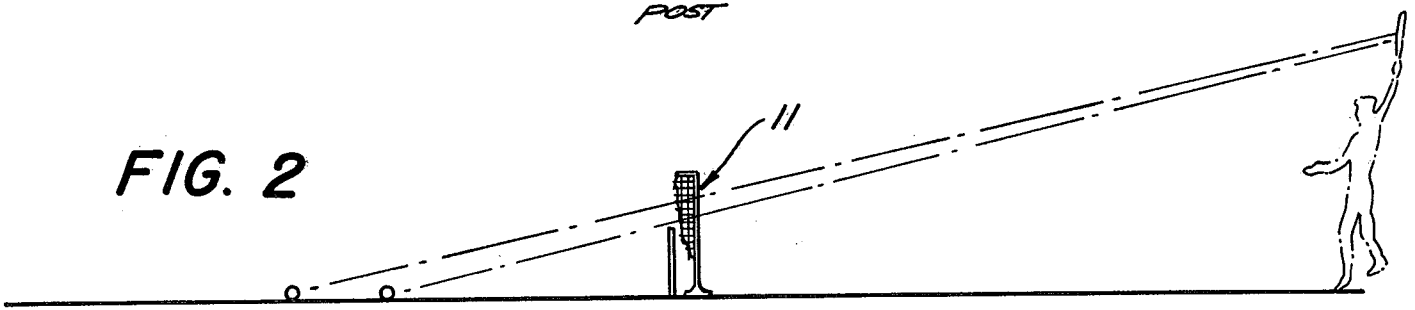
FIG. 2 is a side elevational view thereof.
Figure 3:
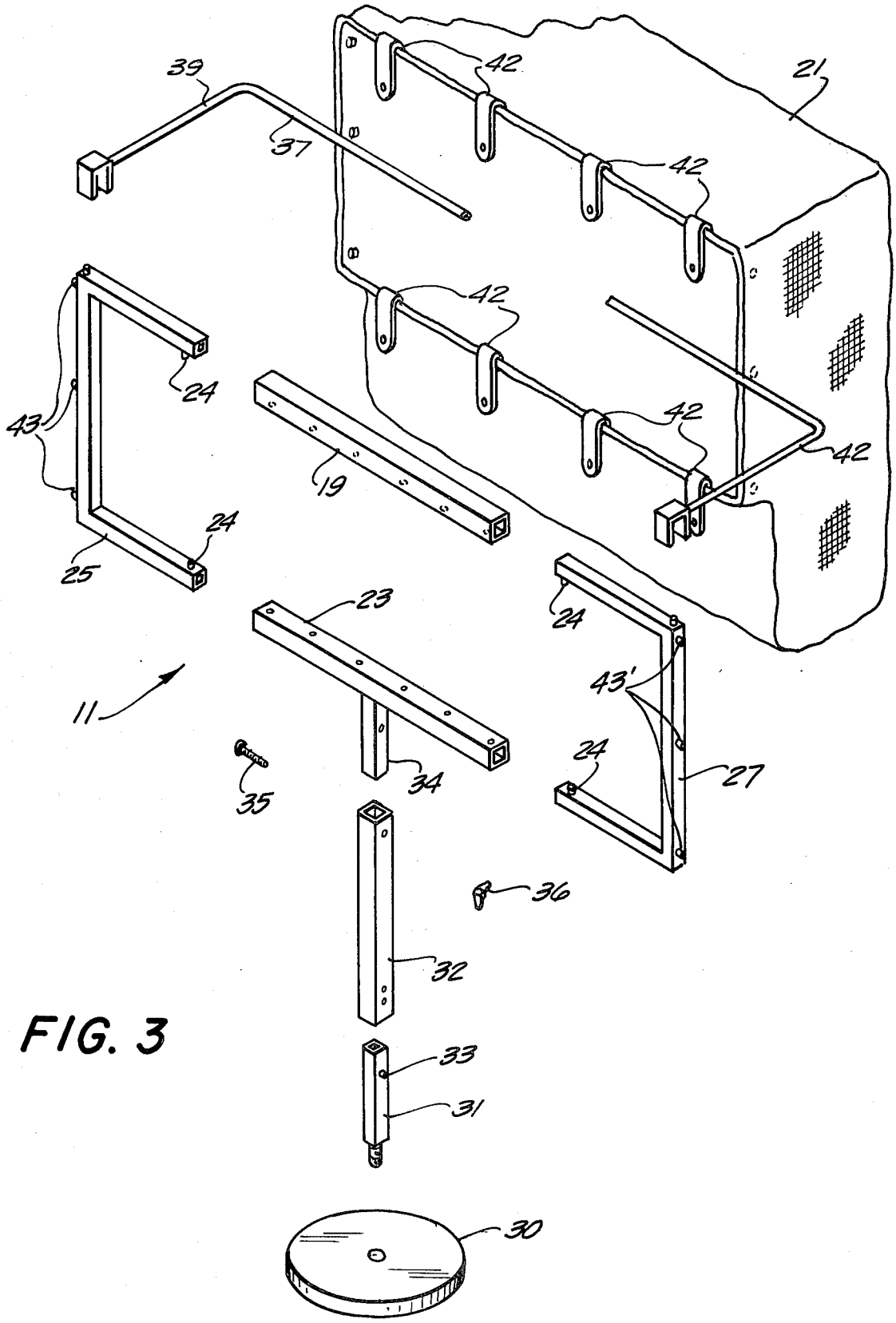
FIG. 3 is an exploded isometric view of the tennis serve training device of this invention.
Figure 4:
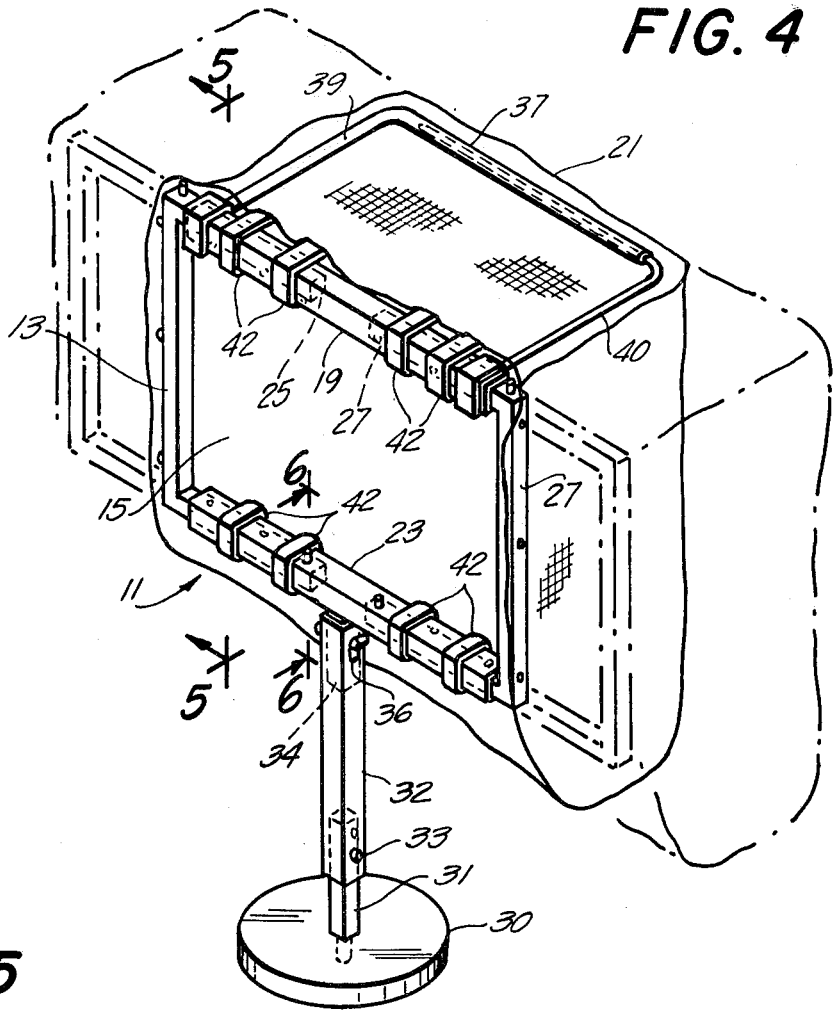
FIG. 4 is an isometric view of the assembled tennis serve training device of this invention.
Figure 5:
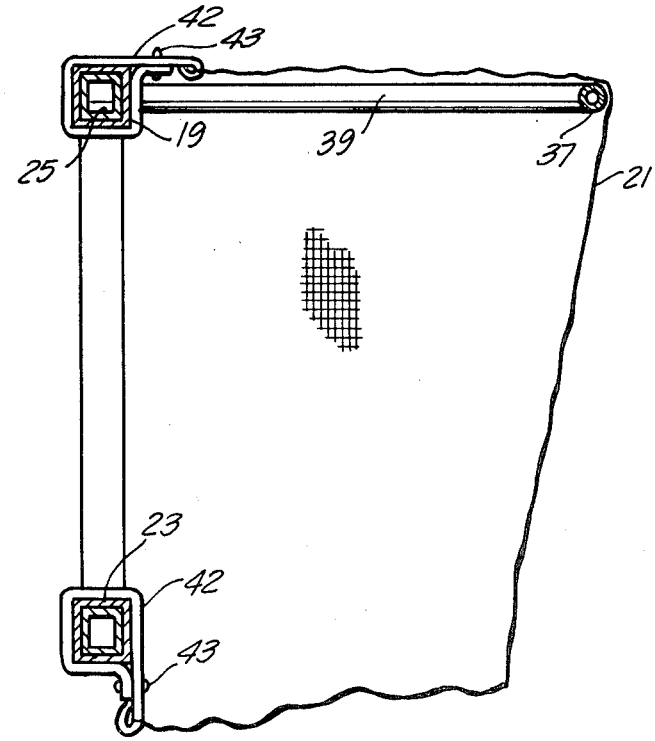
FIG. 5 is a cross-sectional view taken along the line 5—5 of FIG. 4 showing the net supporting straps.
Figure 6:
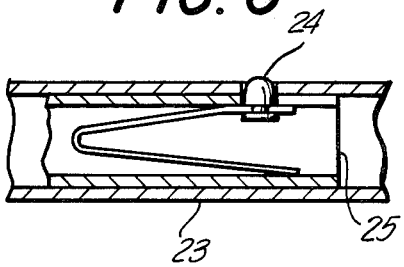
FIG. 6 is a sectional view taken along the line 6—6 of FIG. 4 showing the spring detent which facilitates the adjustment of the operating area of the training device.

In the drawings a tennis serve practice device 11 embodying features of the invention is illustrated with two mutually slidable U-shaped members 25 and 27 shown in a retracted reduced area position in FIG. 4. In the extended open position, as is shown in phantom in FIG. 4, the rectangular enclosure 15 is at its widest dimension, while in closed position it is at its smallest dimension. In a successful embodiment of the invention, these dimensions are 62" and 36", respectively. The adjustability is facilitated by the legs of the U-shaped members 25 and 27 being telescopically received by tubular members 19 and 23 and interposed spring detents 24. Thus, the less experienced tennis player practicing his or her serve would naturally wish to have as wide an area as possible through which to aim his tennis balls; thus the device should be in an open position for the less experienced tennis players. As the player gains more experience and practice aiming his balls to the proper and desired position on the tennis court, he may adjust the device to define a smaller rectangular enclosure area 15 by manipulating the spring detents 24, so that the mutually slidable U-shaped members 25 and 27 overlap a greater portion of the frame 13. The greater the overlap of the mutually slidable U-shaped members 25 and 27 of the frame 13, the smaller the area of the rectangular enclosure 15 becomes.

As explained, the experienced player would have about almost half the length of frame enclosed area through which he must aim his tennis ball to the desired serve area as the beginning player is provided. Thus, in the present invention, a beginning or intermediate tennis player will always have something to work towards, with the aid of the present invention. With respect to perfecting his tennis serve; that is, as he masters one position of the open frame, he may always have a "smaller" position to goad him on to better aimed serves. Thus, too, may the tennis instructor motivate his students to more skilled tennis serves—by demonstrating that with experience and practice the student tennis players may achieve facility in tennis serves by aiming more accurately through the proper area to simulate placement of the ball in the desired area of the service box on the tennis court. Similarly, a group of student tennis players may practice together or against one another, the less experienced players will most likely learn from observing the skill of the better players in aiming the tennis ball through the rectangular enclosure area to simulate placement of the service box of the tennis court. Individuals may also use the device 11 against a wall such as a handball court wall, where an individual tennis player may easily and efficiently practice his tennis serve skill. The net 21 is attached to the frame 13 and provides a full backing for the rectangular enclosure 15 through which the player hits the tennis balls.

The training device 11 of this invention is designed to be adjustable also with respect to its height (to accommodate variations between individual tennis players and to provide different penetrations into the tennis service box). The device 11 is provided with a base 30, having screwed therein a substantially vertical lower support 31 which fits into a main upright support 32 and is coupled therewith by spring detents 33. A downwardly depending support 34 on tubular frame member 23 is adjustably received by the top of main support 32 and is adjustably coupled therewith by a bolt 35 and wing nut 36. In this manner the frame 13 may be adjusted vertically depending on height and service height of the player.

A rearwardly extending net brace 37 advantageously cooperates in suspending net 21 in a manner facilitating reception and collection of tennis balls. The brace 37 includes tubular angle members 39 and 40 releasably connected in any suitable manner at one end to the upper extremity of U-shaped members 25 and 27, respectively. The other end of the angle members 39 and 40 are telescoped with one another to accommodate lateral adjustment of frame 13.

The net 21 assumes the shape as shown and is suspended from frame 13 and brace 37 by means of a number of conveniently located webs or straps 42 with releasable snaps 43 and by snaps 43'.

When using the tennis serving, training and practice device 11 on the court, the player will normally set the device in front of the net of the service box into which he desires to serve. In most instances, the device will be disposed along the net and within the inner half of the net line. In most instances, the inner side of the device will extend beyond the center service line, particularly when the frame 13 is in an extended position. The reason for this disposition is that serves intended to be dropped or landed within the service box and close to the center service line will travel over the net on the same or near side of the center service line corresponding to that where the server is standing and serving the ball. Incidentally, many players may prefer to locate the training device 11 on the opposed side of the net rather than the near side. Of course, this can be done without departing from the spirit of the present invention. One of the advantages of the device of this invention is that the server is permitted to serve from all positions from the base line into the target area and still land in the service court. As stated in the foregoing, the frame 13 may be contracted to reduce the target area for the advanced player to practice his serve. Of course, the device 11 may be shifted along the net either on the near side or far side, depending on the preference of the server, to practice landing serves in desired locations within the service box, whether it be the deuce court or add court. As stated in the foregoing, the elevation mechanism will permit the server to practice deeper penetration into the service court.

It is suggested that the device 11 of this invention be manufactured substantially of steel, particularly the tubing portions; and that the base be made of cast iron for steadiness and strength. The net may be made of any suitable material such as nylon or cotton. Furthermore, the frame may be provided with handle to facilitate carrying and moving of the device 11.

From the foregoing, the construction and operation of the device will be readily understood and further explanation is believed superfluous.

The present device is thought to be an improvement over tennis serve practice devices of the prior art and those already on the market because it is portable and may be transported by automobile from home to tennis court and easily and rapidly assembled, and because it is readily adjustable by means of mutually slide-locking members and manipulatable by spring detents. It is collapsible and portable by hand from car to court. It may be used by an individual practicing his tennis serve; by an instructor demonstrating proper tennis serve positions; and/or by a number of persons practicing their tennis serves individually and simultaneously and prior to playing or as drill reinforcement. The training device of this invention will take the drudgery out of practicing proper serve. It also serves to challenge the tennis player by providing lateral adjustment for their different level of competency, (i) fully extended—novice; (ii) intermediate setting—average—good; and (iii) fully contracted—advanced player. Also, a vertical adjustment provides for deeper penetration into the service court.

The invention includes all novelty residing in the description and drawings. It is obvious to those skilled in the art that various minor changes can be made without departing from the concept of this invention and all such as fall within the reasonable scope of the appended claims are included.

What is claimed is:

1. A tennis serve training device having an adjustable frame defining an adjustable target area, said frame defining a rectangular enclosure through which a tennis ball may pass; said frame including two mutually slidable U-shaped members having upper and lower legs and an upper and lower tubular member intermediate said U-shaped members for receiving respectively, said upper and lower legs of said U-shaped members; and coupling means for releasably coupling said frame members in selected adjusted position; a base, an upright means attached to said base and supporting said frame, a U-shaped brace, said brace comprising a pair of angle members, one end of each angle member releasably connected to the upper part of respective U-shape members of said frame and the other end having telescoping means for adjusting one angle member with respect to the other whereby said brace is adjustable with said frame, said U-shaped brace extending laterally from said upper part of said frame; a net, said net being suspended over said brace and being connected with upper and lower parts of said frame and defining a relatively large pocket for receiving and collecting balls passing through said frame, said net being connected to said frame by a plurality of snap fasteners.

2. The invention of claim 1, wherein the upright support means is adjustable in height.

3. The invention of claim 2, wherein the support means includes a lower support member threadably coupled with the base.

4. The invention of claim 2, wherein the support means includes a main upright support member and a downwardly depending support member on the lower tubular member of the frame telescoped in the main support member and coupling means adjustably coupling the downwardly depending support member in the main support member.

5. The invention of claim 1, wherein all of the frame members are tubular.

6. The invention of claim 1, wherein the coupling means are spring detents.

7. The invention of claim 1, wherein the frame is equipped with a handle.

8. The invention of claim 1, wherein the parts of the said device are detachable and collapsible.

* * * * *